US010066651B2

(12) United States Patent
Sauer et al.

(10) Patent No.: US 10,066,651 B2
(45) Date of Patent: Sep. 4, 2018

(54) COMPRESSED-AIR SYSTEM HAVING A SAFETY FUNCTION AND METHOD FOR OPERATING SUCH A COMPRESSED-AIR SYSTEM

(71) Applicant: FESTO AG & Co. KG, Esslingen (DE)

(72) Inventors: Josef Sauer, Wernau (DE); Alexander Vargas, Nurtingen (DE); Manfred Jainczyk, Deizisau (DE); Eckard Roos, Muhltal (DE); Peter Beil, Kirchheim (DE)

(73) Assignee: Festo AG & CO. KG, Esslingen (DE)

( * ) Notice: Subject to any disclaimer, the term of this patent is extended or adjusted under 35 U.S.C. 154(b) by 155 days.

(21) Appl. No.: 15/307,271

(22) PCT Filed: Mar. 6, 2015

(86) PCT No.: PCT/EP2015/000512
§ 371 (c)(1),
(2) Date: Oct. 27, 2016

(87) PCT Pub. No.: WO2015/165561
PCT Pub. Date: Nov. 5, 2015

(65) Prior Publication Data

US 2017/0051768 A1 Feb. 23, 2017

(30) Foreign Application Priority Data

Apr. 30, 2014 (DE) ..... 10 2014 006 357

(51) Int. Cl.
*F15B 20/00* (2006.01)
*F15B 19/00* (2006.01)
*F17C 13/04* (2006.01)

(52) U.S. Cl.
CPC ..... *F15B 20/008* (2013.01); *F15B 19/00* (2013.01); *F17C 13/04* (2013.01);
(Continued)

(58) Field of Classification Search
CPC ..... F15B 20/008; F15B 19/00; F15B 2211/3052; F15B 2211/30565;
(Continued)

(56) References Cited

U.S. PATENT DOCUMENTS 2,354,791 A * 8/1944 Boldt ..... F16K 11/044 137/112
2,551,045 A * 5/1951 Parker ..... F16K 35/04 137/113

(Continued)

FOREIGN PATENT DOCUMENTS

CN 1170894 1/1998
DE 102004042891 10/2005

(Continued)

*Primary Examiner* — Minh Le
(74) *Attorney, Agent, or Firm* — Hoffmann & Baron, LLP

(57) ABSTRACT

A compressed-air system having a safety function and a method for operating such a compressed-air system. The compressed-air system contains two working valves, which each can selectively assume an aerating position that aerates a load and a venting position that vents the load. Both working valves are redundantly connected on the output side to the load by means of a separating device. The separating device allows one or the other of the working valves to be separated, while the aeration of the load is maintained, in order to subject the one or the other working valve to an examination of the switching function of the one or the other working valve.

16 Claims, 2 Drawing Sheets

(52) U.S. Cl.
CPC ..... *F15B 2211/3052* (2013.01); *F15B 2211/3056* (2013.01); *F15B 2211/30565* (2013.01); *F15B 2211/634* (2013.01); *F15B 2211/6313* (2013.01); *F15B 2211/855* (2013.01); *F15B 2211/8855* (2013.01); *F17C 2250/0626* (2013.01)

(58) Field of Classification Search
CPC ..... F15B 2211/6313; F15B 2211/634; F15B 2211/855; F15B 2211/8855; F15B 2211/30562; F17C 13/04; F17C 2250/0626
USPC ..... 137/596, 487.5, 111, 112, 113, 625.2, 137/625.25, 627.5, 628, 599.08, 596.16; 60/408, 409, 462
See application file for complete search history.

(56) References Cited

U.S. PATENT DOCUMENTS 2,627,388 A * 2/1953 Johnson ..... F16K 11/056 137/112
2,811,979 A * 11/1957 Presnell ..... F15B 13/02 137/112
3,151,623 A * 10/1964 Riordan ..... F15C 3/06 137/112
3,188,916 A 6/1965 Beatty
3,770,012 A * 11/1973 Bitzer ..... F15B 11/18 137/119.02
4,261,450 A * 4/1981 Matsushima ..... B30B 15/142 192/12 C
4,706,548 A 11/1987 Baldauf et al.
5,927,324 A * 7/1999 Russell ..... F15B 20/001 137/596.16
6,679,281 B1 * 1/2004 Thiry ..... E02F 9/2217 137/118.06
7,396,029 B2 * 7/2008 Hecker ..... B60G 17/0155 280/124.16
7,699,073 B2 * 4/2010 Decker ..... F15B 11/068 137/599.08
7,891,375 B2 * 2/2011 Decker ..... F15B 11/0406 137/596.1
7,918,367 B2 * 4/2011 O'Donnell ..... F17C 7/00 137/113
8,561,630 B2 * 10/2013 Hu ..... F16K 11/0716 137/113
8,567,442 B2 * 10/2013 Christiani ..... F15B 11/068 137/1
8,701,706 B2 * 4/2014 Schmidt ..... F15B 13/0405 137/596.14
9,238,392 B2 * 1/2016 Geiger ..... B60G 17/0523
2003/0010198 A1 1/2003 Fuss et al.
2004/0250861 A1 * 12/2004 Schnell ..... F16K 37/0083 137/599.08
2005/0076950 A1 * 4/2005 Berbuer ..... B60H 1/00978 137/112
2005/0150554 A1 * 7/2005 Schnell ..... F15B 20/008 137/599.08
2006/0042250 A1 3/2006 Schmieding
2012/0048396 A1 * 3/2012 Takemoto ..... F15B 19/005 137/487.5
2014/0060653 A1 * 3/2014 Kaupert ..... B60T 13/662 137/1
2015/0198183 A1 * 7/2015 Moser ..... F15B 20/00 137/1

FOREIGN PATENT DOCUMENTS

DE 102010041203 1/2012
DE 102009025502 6/2014
EP 0780743 6/1997
EP 1266147 3/2005
EP 1645755 2/2010
EP 2479440 7/2012
WO WO2012004313 1/2012

* cited by examiner

COMPRESSED-AIR SYSTEM HAVING A SAFETY FUNCTION AND METHOD FOR OPERATING SUCH A COMPRESSED-AIR SYSTEM

This application claims priority based on an International Application filed under the Patent Cooperation Treaty, PCT/EP2015/000512, filed Mar. 6, 2015, which claims priority to DE102014006357.7, filed Apr. 30, 2014.

BACKGROUND OF THE INVENTION

The invention relates to a compressed-air system having a safety function, with a first and a second working valve, each of which has a working connection and a venting connection connected or connectable to the atmosphere, wherein the two working connections are connected in parallel fluid communication with one and the same load output of the compressed-air system which load output is connected or connectable to a load, wherein each working valve is switchable into a venting position connecting its working connection with its venting connection and wherein the two working valves can simultaneously assume their venting position. The invention also relates to a method for operating such a compressed-air system.

A compressed-air system having a design in the above sense is known from EP 1 645 755 B1 and contains as a particular aspect a safety function, ensuring what is known as two-channel venting of a load connected to the load output. This means that a load, for example an automation system, has two redundant working valves available for venting, so that if one of the working valves fails reliable venting can nevertheless be ensured by means of the other working valve. In the case of EP 1 645 755 B1 the safety function is integrated into a soft start device of the compressed-air system, with the help of which the compressed air supply to a load can be optionally switched on or off, wherein upon switching on a smooth pressure build-up is ensured and wherein switching off is accompanied by venting on the load side.

From EP 1 266 147 B1 a fluid engineering system that can be operated by compressed air is also known that has a safety function.

From DE 10 2010 041 203 A1 an arrangement and a method for feeding an excipient are known, wherein a compressed-air system is used, which in one embodiment has two valves, the outputs of which are connected by the interposing of a shuttle valve with one and the same working cylinder.

DE 10 2004 042 891 B3 discloses a safety circuit having a plurality of solenoid valves, the functional reliability of which can be checked by means of electrical encoders.

DE 10 2009 025 502 B4 describes a pneumatic valve device, providing a venting cross-section that is greater than the aerating cross-section.

Current safety standards require cyclical examination that two-channel venting of a compressed-air system is being guaranteed. This is against a background in which a wide variety of defect scenarios are conceivable and known, which can lead to a breakdown of both channels or both working valves. An example here would be the sticking of the valve member gasket with the resultant impossibility to switch over the working valve or a rupture of the return spring with the resultant blocking of the current switching position of the working valve. This problem is particularly pronounced in compressed-air systems which are used to operate loads which are switched on and have to be supplied with compressed air for long periods. Here, though, the additional problem arises that an interruption in the operation of the load to check the functional capability of the working valves is not really acceptable, because this is associated with an interruption in the process performed by the load.

Consideration has therefore previously been given to checking the working valves while in operation, by only operating them until the valve member briefly performs just a limited partial stroke. In this way only slight venting takes place, causing only minor disruption to the load. In sensitive loads, however, such a partial stroke test can also result in an error message and a possible operational interruption.

Furthermore, the partial stroke examination does not provide any indication that the working valve is actually in a position to fully switch over to the venting position if necessary.

SUMMARY OF THE INVENTION

In this regard, an essential object of the invention is to adopt measures that allow checking of the functional capability of the two-channel venting without disrupting or interrupting the operation of a connected load.

To achieve this object, in a compressed-air system of the abovementioned type, according to the invention it is provided

- that each working valve also has a supply connection connected or connectable to a compressed-air source and optionally is switchable to an aerating position connecting its working connection with its supply connection or to its venting position;
- that the venting cross-section enabled in the venting position by each working valve for flow of compressed air is bigger than the maximum aerating cross-section that can be enabled in the aerating position;
- that in the connection between the two working connections and the load connection a separating device is inserted, allowing a temporary fluid-tight separation optionally of the working connection of the first working valve or of the working connection of the second working valve of both the load connection and the working connection of the respective other working valve and in doing so maintains a fluid communication between the load connection and the working connection not separated;
- and that both working valves have a switching function examination means assigned to them, able to check the switching function at least of the working valve, the working output of which is currently separated by the separating device from the load connection and from the working output of the other working valve, while this other working valve assumes its aerating position.

In a method of the abovementioned kind said object is achieved in that with uninterrupted aeration of the load connection an examination process of the functioning of the working valves is carried out, in which based on an operating state, in which both working valves assume the aerating position, initially the first working valve and then the second working valve is separated by the separating device from the load connection and from the respective other working valve, wherein the respective separated working valve, with the other working valve remaining connected with the load connection with maintenance of the aerating position, in the course of a test operation activity is switched over to the venting position and a correct switchover is verified with the help of the switching function examination means.

In this way, the two-channel capability, thus reliable venting of the load, is guaranteed even if the venting function of one of the two working valves fails, wherein at the same time a redundant, dual venting possibility is guaranteed, without having to interrupt the compressed-air supply, that is to say the aeration of the connected load. Each working valve offers the possibility, as a function of its switching position, of optionally aerating or venting the connected load. Accordingly, each working valve can be switched either into an aerating position or a venting position. Because the venting capacity of each working valve is greater than the maximum aeration capacity, reliable venting can be guaranteed even if just one of the working valves switches over to the venting position and the other working valve due to a malfunction remains in the aerating position. And finally, the separating device inserted in the connection between the two working connections and the load connection allows an intentional selective separation of each working valve from the load and from the other working valve, so that this separated working valve can be examined for a correct switching function, without adversely affecting the compressed-air supply guaranteed by the other working valve. The other functional capability of the channel used for venting, for example the penetrability of a connected silencer, can also be examined in this way without adversely affecting operation. The switching function examination means assigned to the working valves are able to examine the correct switching function of the separated or decoupled working valves, while the other working valve maintains the aerating position and ensures an unrestricted compressed-air supply to the load.

A preferred examination cycle for the functional capability of the two working valves begins in a state in which the two working valves each adopt the aerating position. This is also the regular normal operating state of the compressed-air system, in which the load is aerated via both working valves redundantly. On this basis, by corresponding operation of the separation device, first one working valve is separated from the load connection and from the other working valve, so that only the other working valve is undertaking the aeration of the load. The separated working valve is then caused to perform a test operation activity in which it is switched over fully to the venting position. A correct switchover is verified with the help of the assigned switching function examination means. Then this separated working valve is switched back to the aerating position. By means of a similar process decoupling and examination of the other of the two working valves then follows.

In this way, the complete venting function of both working valves, and thus the safety-related function, can be tested, without interrupting operation of the connected load. Advantageous further developments of the invention arise from the subclaims.

A particularly inexpensively designed separating device contains an 'OR' valve, having two Input connections, in each case connected with the working connection of one of the two working valves. An output connection of the 'OR' valve serves to connect the load. The 'OR' valve switches over automatically as a result of the pressure differential present at the two working connections and consequently at the two input connections. Thus the switchover of the 'OR' valve can be influenced by the switching position of the two working valves. If a working valve is to be separated from the load and from the other working valve, it is sufficient to switch it over to the venting position, so that at the input connection assigned a drop in pressure occurs, which results in the 'OR' valve closing the input connection assigned. In this way the switching function of the separated working valve can be examined, wherein the switchover to the venting position can be directly used as a test operation activity, the correct functional capability of which can be verified by the switching function examination means.

An improved embodiment of the invention provides that the separating device is designed as a multi-position valve that can be operated independently of the fluid pressures present on the working outputs. The multi-position valve has a neutral position, in which it simultaneously enables a fluid communication between both working connections and the load connection, so that when both working valves are simultaneously in the aerating position a redundant compressed-air supply to the load is guaranteed. This represents the normal operating position of the multi-position valve. If one of the working valves switches to the venting position as a result of a malfunction, a safety shutdown of the connected load can be derived from this, with sufficient compressed air no longer being supplied, because the venting capacity of the working valve that is in the venting position is greater than the aeration capacity of the working valve that is in the aerating position. If the correct two-channel capability of the venting is to be examined, the multi-position valve can be switched over from the neutral position optionally to a first or a second separated position, in which it respectively decouples one of the two working valves from the load and from the other working valve in a fluid-tight manner and in so doing continues to guarantee a continuous fluid communication between the other working valve and the load, so that unrestricted aeration of the same is maintained. The working valve separated in this way can then be put through a test operation activity, in which with the help of the switching function examination means assigned the functional capability of the switching over can be examined.

The multi-position valve used as a separating device is preferably a three-position valve. For practical purposes it has a stable mid-position constituting the neutral position, from which it can be deflected in one or other direction to achieve one or other separated position, wherein it remains deflected until a control signal is applied. A monostable 3/3-way valve is preferably used as the separating device.

The switching function examination means for practical purposes contain position detection means, with the help of which a change in position of the valve member of the relevant working valve can be detected. By way of example, a position sensor is involved, which responds if the valve member of the working valve assumes a switching position which reliably defines the venting position.

Pressure detection means are also suitable for use as switching function examination means. These pressure detection means are integrated into the compressed-air system in such a way that they respond when there is a change in pressure in the fluid pressure present at the working connection. If the working valve is switched over from the aerating position to the venting position, a drop in pressure occurs at the working connection, which the detection means are able to register. Needless to say, the pressure detection means do not have to be positioned directly on the working connection itself, but can be connected at any point of the venting channel section.

A further advantageous possibility of checking for a correct venting function is to assign each working valve a control air reservoir, which in the aerating position is being filled or is filled and in the venting position is vented by the relevant working valve. Assigned detection means are able to detect, in the venting position of working valve, a time-dependent pressure change or the passage of a compressed-air venting flow during venting. With the help of the measured values, by comparing with reference values, it is possible to determine if the channel section used for venting is open and/or if there is possibly a malfunction of the working valve and/or if a silencer attached to the venting connection may be blocked.

It is possible to assign to each working valve its own control air reservoir but also to assign a control air reservoir jointly to both working valves.

Of particular advantage is a design of the compressed-air system in which the control air reservoir is connected to the working connection of the working valve, so that it is always filled with compressed air if the working valve assumes the aerating position. An alternative design provides that the working valve, in addition to the working connection, has a separate filling connection, to which the control air reservoir is connected and which is connected to the supply connection, when the working valve is in the venting position. In this case a 4/2-way valve is preferably used as the working valve, whereas otherwise a 3/2-way valve is recommended as a working valve.

The separating device preferably has self-function examination means assigned, via which the separating function of the separating device can be examined, while both working valves assume the aerating position. Such self-function examination means can be used in particular in conjunction with a separating device constituted by a multi-position valve.

In a preferred method, with the help of the self-function examination means, prior to performing a test operation activity relating to a working valve, an examination of the correct functional capability of the multi-position valve is carried out. Here, with both working valves switched over to the aerating position state, the multi-position valve, starting from the neutral position, is first switched over to one shut-off position and then back to the neutral position and then to the other shut-off position and back to the neutral position. In both shut-off positions of the multi-position valve the load connection continues to be aerated, because it is connected to a working valve that has not been shut off and which assumes the aerating position. The self-function examination means preferably contain position detection means, which respond when there is a change in position of a valve member of the separating device. By way of example at least one position sensor is involved, able to detect if the valve member of the separating device assumes a switch position specifying the first shut-off position and/or the other shut-off position.

Once it has been verified that the separating device is functioning correctly, a reliable channel or a reliable valve exists. Then the separating device verified as being reliable, by switching over to one or other shut-off position, can be connected with one or other working valve, in order to perform the abovementioned examination of the switching function with regard to the other working valve.

The compressed-air system is for practical purposes equipped with an electronic controller, to which the various valves and examination means are connected. The electronic controller can bring about a test procedure for the functioning of the working valves with uninterrupted aeration of the load connection. In this test procedure, starting from the operational state in which both working valves assume the aerating position, first one and then the other working valve is separated by the separating device from the load connection, wherein the respectively separated working valve, in the course of a test operation test operation activity, is operated and with the help of the switching function examination means undergoes a switching function examination. Here the other working valve remains connected to the load connection and maintains the aeration of the load.

The two working valves are preferably of the type that can be electrically operated. The same applies to an actively switchable multi-position valve constituting the separating device. Directly electrically operable or also electro-pneumatically piloted valves may be involved here. The electric operation can in particular also be triggered so that the relevant valve itself can be switched over by means of a fluid pressure, supplied by a separately installed control valve which, for its part, is electrically operable.

Depending on the intended purpose of the compressed-air system it can be equipped with more than the valves and/or other fluid engineering devices described. The compressed-air system is preferably used as what is known as an on-off valve, upstream of a load in the form of a pneumatic system and with the help of which the compressed air to be supplied to the load can be switched on or off. In this connection in particular, the compressed-air system can also be equipped with what is known as a soft-start function.

BRIEF DESCRIPTION OF THE DRAWINGS

The invention will now be explained with reference to the attached drawing. This shows as follows.

DETAILED DESCRIPTION OF THE PREFERRED EMBODIMENTS

Figure 1:
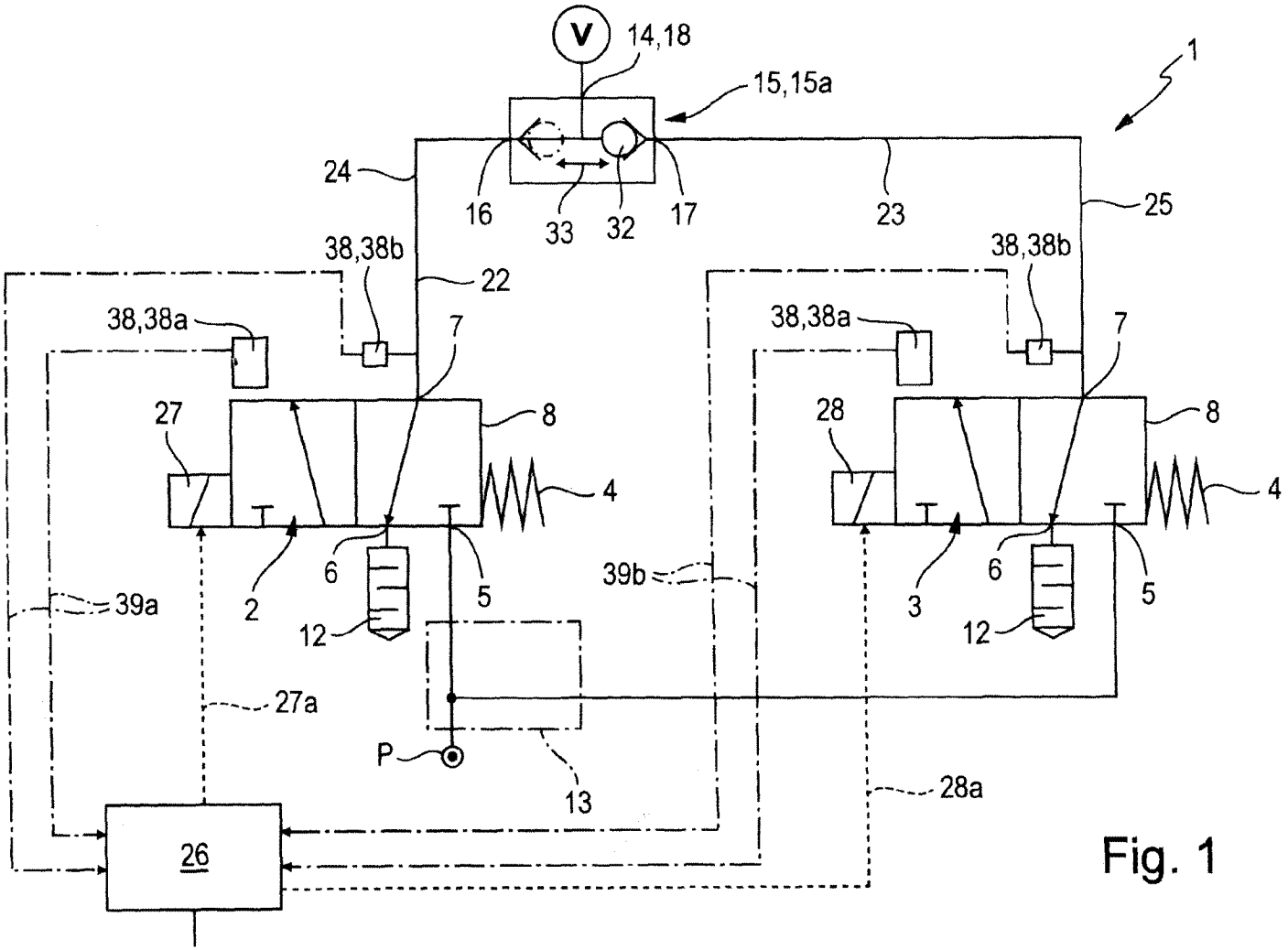
FIG. 1 the circuit of a preferred design of a compressed-air system according to the invention, and FIG. 2 the circuit of a further embodiment of the compressed-air system according to the invention.

The circuits shown in the drawing implement in each case a safety-related compressed-air system 1 with what is known as a two-channel design. The compressed-air systems 1 are advantageously designed so that in any operating situation they can switch off on a two-channel basis in order to guarantee the reliable venting of a connected load V. Even during a test procedure to test the functional capability of the valve technology, at no time can the compressed-air system lapse into single-channel mode.

The following description relates jointly to all illustrated compressed-air systems 1, unless stated to the contrary in an individual case.

The compressed-air system 1 in the exemplary embodiments is built as what is known as an on-off valve, with the help of which the compressed air supply to a load V can be optionally switched on or off. In the switched-on state the compressed-air system 1 ensures aeration of the load V, thus a supply of compressed air, which the load V needs for its operation. In the switched-off state of the compressed-air system 1 the load V is reliably vented, so that it cannot perform any undesired activities.

The load V can be any number of devices or machines operated with compressed air, wherein one or more systems operated with compressed air may also be involved. A conceivable example would be a production and/or assembly device in the area of automation.

The compressed-air system 1 contains two working valves 2, 3, which in the following are referred to also as first working valve 2 and second working valve 3. The working valves 2, 3 for example be 3/2-way valves, wherein alternatively, however, valves with other functionality can be used.

The working valves 2, 3 are electrically operable. These may be directly electrically operable valves or electro-pneumatically piloted valves. In an electro-pneumatically piloted design, each working valve 2, 3 is assigned at least one electrically operable pilot valve, which can be implemented in the unit with the working valve 2, 3 or also integrated as an individual pilot valve in the compressed-air system 1.

The working valves 2, 3 are preferably monostable valves, which when in the electrically not actuated state assume a basic position defined by a spring means 4. This ensures that in the event of a power failure the working valves 2, 3 switch back to the defined basic position.

Each of the two working valves 2, 3 has at least one supply connection 5, one venting connection 6 and one working connection 7. Each working valve 2, 3 can optionally assume a venting position or an aerating position as shown in the drawing. In order to switch between the two positions at least one valve member 8 of the relevant working valve 2, 3 can be moved and repositioned. The valve member 8 is for example a valve gate.

The venting connection 6 is preferably constantly connected with the atmosphere. The drawing illustrates a silencer 12 connected to the venting connection 6, through which the exhaust air can escape into the atmosphere in muted fashion. Depending on the design of the compressed-air system 1 between the venting connection 6 and the atmosphere further fluid engineering means can be connected, though in the exemplary embodiment this is not the case.

The supply connection 5 is connected with a compressed air source P. The supply connections 5 of both working valves 2, 3 are connected to a common compressed air source P. The compressed-air system 1 can have a system housing, on which pneumatic interface means are present, to which the compressed air source P for connection with the two supply connections 5 can be mechanically connected in a fluid-tight manner.

A double-dot-dash symbol 13 is intended to illustrate that the compressed-air system 1 can have valves and/or fluid engineering means that are not shown that are inserted in the connection between the supply connections 5 and the compressed air source P. These means can serve, in particular, to implement a soft-start function. In the specific exemplary embodiment this is not the case, as here the supply connections 5 have a direct through-connection to the preferably external compressed air source P.

The working connection 7 of each working valve 2, 3 is connected to a load output 14 to which, when the compressed-air system 1 is in operation, the aforementioned load V is connected. Here there is a parallel fluid communication between the between the load V and on the one hand the working connection 7 of the first working valve 2 and the working connection 7 of the second working valve 3. In other words, the load V is connected in parallel with both working connections 7, wherein however in the connection between these three connections a fluid engineering separating device 15 is inserted, able to optional close or enable in a fluid-tight manner a fluid communication between the load V and the two working connections 7 in a manner to be described.

In the venting position of a working valves 2, 3 shown in the drawing there is an open fluid communication between the working connection 7 and the venting connection 6, while at the same time the supply connection 5 is closed. In this venting position, therefore, the load V, where the separating device 15 so allows, is via the working valve 2, 3 in the venting position into the atmosphere.

The separating device 15 has an input connection 16 in fluid communication with the working connection 7 of the first working valve 2 and furthermore a second input connection 17 in fluid communication with the working connection 7 of the second working valve 3. It furthermore has an output connection 18, which preferably simultaneously forms the load connection 14. A first communication channel 22 runs between the first input connection 16 and the working connection 7 of the first working valve 2, while a second communication channel 23 creates a fluid communication between the second input connection 17 and the working connection 7 of the second working valve 3.

In the venting position of the first working valve 2 the first communication channel 22, together with the subsequent channel section connecting to the atmosphere, forms a first venting channel 24. In a corresponding manner the second communication channel 23 in the venting position of the second working valve together with the channel section connecting to it and similarly leading to the atmosphere, forms a second venting channel 25. If a working valve 2, 3 assumes its venting position, the load V can then be vented via the now open venting channel 24, 25 into the atmosphere, wherein the resulting compressed air flow can be referred to as a compressed air venting flow.

If a working valve 2, 3 is switched over to the aerating position, it provides fluid communication between the assigned supply connection 5 and the assigned working connection 7, while the similarly assigned aeration connection 6 is separated. In this way compressed air, as part of a compressed air aerating flow, is able to flow from the compressed air source P through the appropriate working valve 2, 3 to the assigned input connection 16, 17 of the separating device 15 and finally to supply the load V to the load connection 14.

The two working valves 2, 3 are preferably designed so that the venting position forms the basic position.

The two working valves 2, 3 can be switched over independently of one another and can be positioned into either the venting position or the aerating position. The electrical control necessary for this is provided by an electronic controller 26, for practical purposes belonging to the compressed-air system 1. The drawing shows, as dot-dash lines, first and second control lines 27*a*, 28*a* leading from the electronic controller 26 to the drive devices 27 and 28 that can be activated electrically of the two working valves 2, 3.

By appropriate control of the two working valves 2, 3 inter alia operating states of the compressed-air system 1 can be set, in which both working valves 2, 3 assume the aerating position or in which the two working valves 2, 3 assume the venting position.

Both the compressed air aerating flow and the compressed air venting flow, occurring between the load V and the working valves 2, 3, pass through the fluid engineering separating device 15. The fluid engineering separating device 15 is in particular a valve, which can take different forms as explained further in the following.

The separating device 15 of the compressed-air system 1 illustrated in in FIG. 1 is designed as an 'OR' valve 15*a*. It contains a control valve member 32, that can be switched over according to the double arrow 33 between two separated positions, wherein the separated position assumed in each case is dependent upon the current pressure differential present at the two input connections 16, 17 and accordingly that at the working connections 7 of the two working valves 2, 3. If the fluid pressure present at the first input connection 16 is greater than the fluid pressure at the second input connection 17, the 'OR' valve 15*a* switches over to the first separated position shown, in which a fluid communication between the first input connection 16 and the output connection 14 is enabled and in which at the same time these two connections 16, 14 are separated in a fluid-tight manner from the second input connection 17. Consequently, in the first separated position the load connection 14 including the load V connected thereto is in fluid communication with the working connection 7 of the first working valves 2 and at the same time separated from the working connection 7 of the second working valve 3.

The 'OR' valve 15*a* switches over itself, without any additional special control, into the second separated position, if the fluid pressure present at the output or at the working connection 7 of the second working valves 3 is greater than that at the output of the first working valve 2. In this case an open fluid communication exists between the load connection 14 and the working connection 7 of the second working valve 3, while at the same time the working connection 7 of the first working valve 2 is separated both from the load V and from the second working valve 3 in a fluid-tight manner.

Therefore, the switching position of the 'OR' valve 15*a* can be specified via the pressure differential between the two working connections 7, which in turn can be specified with the help of the switching position of the two working valves 2, 3.

In order to apply a high pressure at one of the input connections 16, 17, the assigned working valve 2 or 3 is switched to the aerating position. In order to apply a low pressure, the assigned working valve 2, 3 is simply switched over to the venting position.

If both working valves 2, 3 are simultaneously in the aerating position, the load V, depending on how the control valve member 32 is oriented, is supplied via the first working valve 2 and/or via the second working valve 3 with compressed air. The same applies to the venting in the event that both working valves 2, 3 are switched to the venting position.

Figure 2:
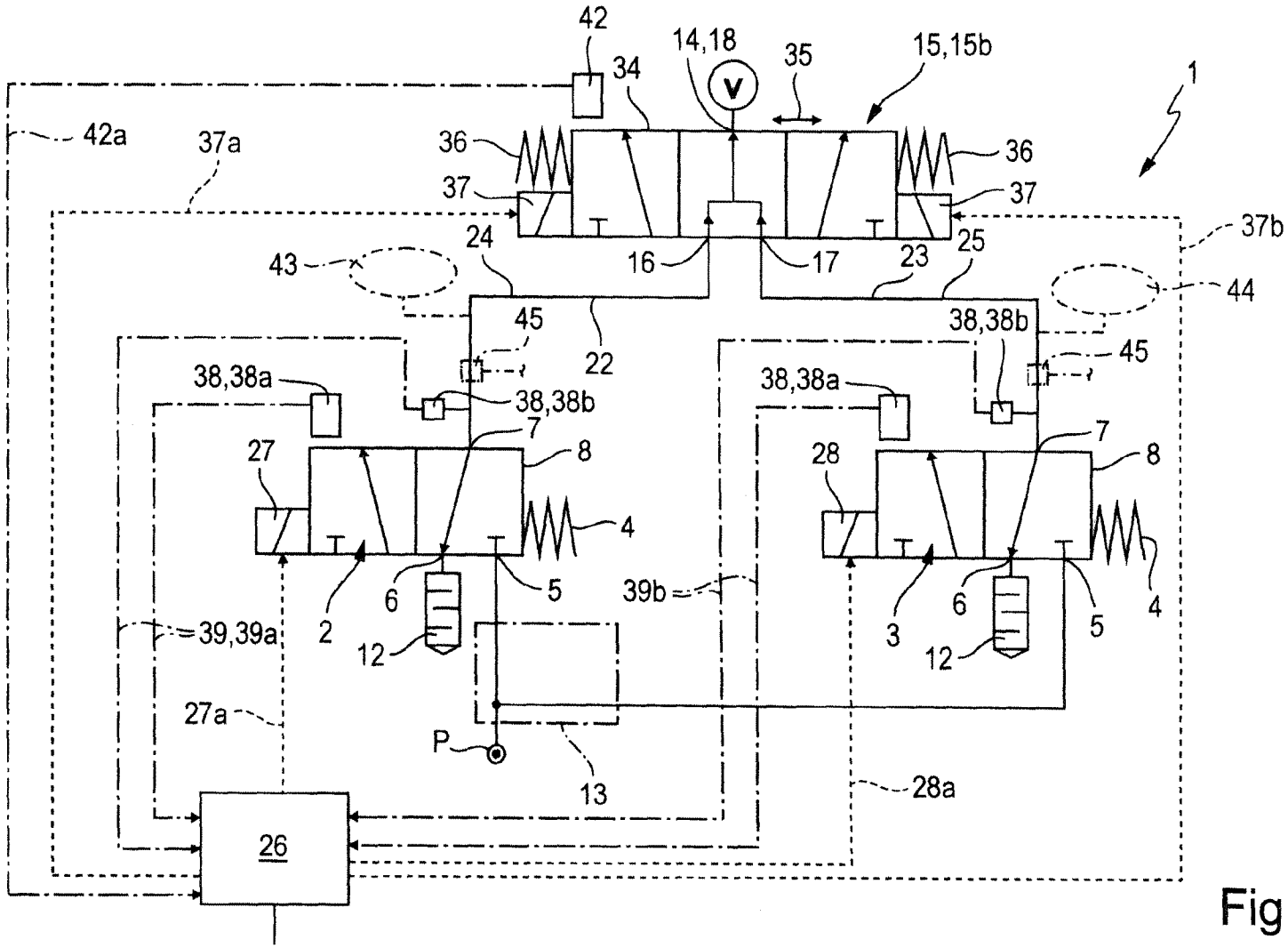

In the compressed-air system 1 shown in FIG. 2 the separating device 15 is designed as a multi-position valve 15*b*, wherein in particular a three-position valve is involved. The multi-position valve 15*b* can assume a neutral position illustrated in FIG. 2, in which it works similarly to a T-piece and connects both input connections 16, 17 in parallel with free passage with the output connection 18. In normal operation of the compressed-air system of FIG. 2 the multi-position valve 15*b* remains positioned in this neutral position. If both working valves 2, 3 assume the aerating position, the load V experiences simultaneous aeration by both working valves 2, 3 throughout. Similarly, the load V is in this case simultaneously vented via both working valves 2, 3, if both working valves 2, 3 are switched over to the venting position.

It can be seen that both compressed-air systems 1 at least in respect of the venting function and preferably also in respect of the aerating function have a two-channel design. The load V can therefore be aerated redundantly and also vented redundantly. The redundant aeration possibility above all is of particular significance, since it ensures that the compressed-air system 1 corresponds to the applicable high safety standards. Even if one of the working valves 2 or 3 should fail, so that one of the two aeration channels 24, 25 fails, one aeration channel 24 or 25 still remains for reliable venting of the load V.

From a safety-related point of view it is also significant here that the venting cross-section for a compressed air venting flow enabled in the venting position by each working valve 2, 3 is greater than the maximum aeration cross-section that can be enabled in the aerating position. The easiest way to achieve this is for the internal valves channels of the working valves 2, 3 to be dimensioned differently and for the valve channel responsible for the aerating flow to have a larger cross-section than the valve channel responsible for the aerating flow. Of course the adaptation to various flow sections can also be performed at another point in the channel section of the compressed-air system 1 used for aeration and/or venting.

The compressed-air system 1 is preferably used for aerating the load V so that both working valves 2, 3 assume their aerating position at the same time. If now as a result of a malfunction or damage one of the working valves 2, 3 should inadvertently switch over the venting position or inadvertently stick in the aerating position, then the one working valve 2 or 3 that has switched over to the venting position, because of the larger aeration cross-section, ensures ventilation of the load V, even though via the aerating working valve compressed air—albeit with a lower flow rate—is being supplied. Thus the load V can switch off for safety reasons until the fault has been cleared. This ensures that the load V is not operated with just one functioning working valve 2 or 3.

The purpose of the separating device 15 is to enable, without interrupting aeration of the load connection 14 and consequently of the load connected to it, a test procedure to test for the correct functioning of the working valves 2, 3. In such a test procedure, based on the operating state just described, in which the two working valves 2, 3 assume the aerating position, initially separate the first working valve 2 and then the other working valve 3 is separated via the separating device 15 from the load connection 14 and from the respective other working valve 3, 2 and in this fluidically separated state examines it for its switching function. Despite the separation of one of the working valves 2, 3 the load V will continue to be supplied with sufficient compressed air here, because its connection to the working valve 2, 3 not separated by the separating device 15 is open.

In the compressed-air system 1 illustrated in FIG. 1, the separation of one or other of the working valves 2, 3 can be brought about simply by the working valve 2, 3 being switched over to the venting position. In this way at its working connection 7 and at the assigned input connection 16 or 17 a drop in pressure is prompted, causing the control valve member to switch over to a separated position, in which the channel section, in which the working valve 2, 3 switched over to the venting position is inserted, is unpressurised.

In the compressed-air system 1 illustrated in FIG. 2 the separation in a fluid-tight manner or decoupling of the desired working valve 2, 3 takes place by a controlled remote operation of the multi-position valve 15*b*. The multi-position valve 15*b* contains at least one control valve member 34 that can be switched over in the course of a switchover movement 35 between various switching positions and can in this way be positioned, apart from in the already mentioned neutral position, in two different separated positions as well. For practical purposes the neutral position is located between the two separated positions, so that the switching over between the two separated positions is subject to the neutral position being adopted for at least a brief time.

In the first separated position, in which the multi-position valve 15*b* in FIG. 2 has moved to the left, the working connection 7 of the first working valve 2 is as before in fluid communication with the load connection 14, while the second input connection 17 and therefore the working connection 7 of the second working valve 3 is separated from both the load connection 14 and from the working connection 7 of the first working valve 2 in a fluid-tight manner. In the second separated position of the multi-position valve 15*b*, in which the multi-position valve 15*b* or its control valve member in FIG. 2 has moved from the neutral position to the right, there is a fluid communication between the working connection 7 of the second working valve 3 and the load connection 14, while the first working valve 2 or its working connection 7 is separated from the load connection 14 and from the second input connection 17 and therefore from the second working valve 3 in a fluid-tight manner.

This switching function can be implemented particularly easily with the help of a multi-position valve 15*b*, designed according to the exemplary embodiment as a 3/3-way valve. It is preferably a case of a valve where the neutral position is a stable basic position, which is preferably a mid-position, maintained by spring means 36. On this basis, the multi-position valve 15*b* can for practical purposes be deflected in a monostable manner optionally to the first working position or the second working position, which is possible with the help of two electrically operable drive devices 37 assigned to the multi-position valve 15*b*. Each of the two drive devices 37 is connected via an electrical control line 37*a*, 37*b* to the electronic controller 26 and if necessary can be activated and deactivated by this. The drive devices 37 are preferably of one of the designs as explained using the drive devices 27, 28 of the working valves 2, 3. Electromagnetic drive devices 37 or electrically operable pilot valves are preferably involved. The multi-position valve 15*b* can be of the directly electrically operable design or also of an electro-pneumatically piloted design.

Each working valve 2, 3 has switching function examination means 38 assigned it, able to examine the correct switching function of the relevant working valve 2, 3. The switching function examination means 38 are implemented in the form of any suitable detection means or sensor means. In the exemplary embodiments two possible types of such switching function examination means 38 are shown, which as pictured can be present at the same time as or as an alternative to each other. These consist on the one hand of position detection means 38*a*, which respond to the positional change of the valve member 8 of the assigned working valve 2, 3 taking place during a switchover valve, respond and using a position detection of the valve member 8 are able to determine if the relevant working valve 2, 3 has correctly switched over or not.

Another kind of switching function examination means 38 are pressure detection means 38*b*, which respond to a change in pressure in the fluid pressure present, upon switchover of the assigned working valve 2, 3, at the working connection of this working valve 2, 3. The pressure detection means 38*b* are preferably directly connected to the working connection 7 or to the assigned first or second communication channel 22, 23. The pressure detection is based on the fact that the air pressure prevailing at the working connection 7 in the aerating position of the working valves 2, 3 is considerably higher than in the venting position.

Via electrical signalling lines 39*a*, 39*b* the switching function examination means 38 of the two working valves 2, 3 are connected by means of electrical signals with the electronic controller 26.

The separating device 15 is for practical purposes equipped with self-function examination means 42, with which the correct switching function of the fluid engineering separating device 15 can be examined. These self-function examination means 42 are also preferably sensor means of any suitable kind. In the exemplary embodiment only the multi-position valve 15*b* is equipped with such self-function examination means 42, so that the compressed-air system 1 illustrated in FIG. 2 in terms of the intrinsic safety examination is of a higher quality than the less expensive compressed-air system illustrated in FIG. 1.

The self-function examination means 42 can for example be position detection means 38*a*, which respond to the change in position when the control valve member 34 switches over and which are in particular able to detect if the multi-position valve 15*b* upon receipt of an appropriate control signal correctly switches over or has correctly switched over to the first or the second separated position. The self-function examination means 42 are preferably similarly connected by means of at least one electrical signal line 42*a* to the electronic controller 26.

The compressed-air system 1 allows, while retaining the two-channel intrinsic safety, an examination of the functional capability of the two working valves 2, 3 without adversely affecting the aeration or compressed-air supply of the load V connected to the load connection 14.

The working valves 2, 3 are functionally examined alternately, in an operating state of the compressed-air system 1 in which the working valve 2, 3 to be examined is decoupled from the load connection 14 and from the other working valve 3, 2 in the aerating position in a fluid-tight manner. Such an operating state can be specified by means of the separating device 15, by this being switched either over to the first separated position or the second separated position.

The actual functional test procedure consists of the separated working valve 2, 3, in the abovementioned sense, in the course of at least one test operation activity being switched from the aerating position assumed up to that point over to the venting position. With the help of the assigned switching function examination means 38 this allows verification of a correct switchover. The position detection means 38*a* establish here if the valve member 8 is switching and/or has switched over. The pressure detection means 38*b* verify the correct switchover procedure on the basis of the fluid pressure present at the working connection 7, which for a correct switching function must drop to atmospheric pressure, if the assigned working valve 2, 3 has switched over to the venting position. After the test operation activity, the working valve 2, 3 tested is switched back to the aerating position again, so that then the other working valve 2, 3 can be examined in a corresponding way. The working valve 2, 3 not currently in test mode and not separated makes the compressed air necessary for its operation available to the load V.

Since with the compressed-air system 1 from FIG. 1 the switchover of the separating device 15 is caused directly by the switchover of one of the working valves 2, 3 to the venting position, this switchover procedure of the relevant working valve 2, 3 is directly used here as a test operation activity. In the compressed-air system 1 from FIG. 2, however, the test operation activity of a working valve 2, 3 is only triggered once the multi-position valve 15*b* has switched over to the corresponding separated position.

A test cycle is preferably developed in each case which first separates the first working valve 2 and the second working valve 3 by means of the separating device 15 from the load connection 14 and from the respective other working valve 3, 2, wherein the respective separated working valve 2, 3, while the working valve 3, 2 not separated remains connected with the load connection 14 maintaining the aerating position, is switched over in the course of a test operation activity to the venting position and the correct switchover is verified with the help of the switching function examination means 38.

Through a rapid switchover of the separating device 15 pressure drops at the load connection 14, which could adversely affect the operation of the connected load V, are avoided without problems. There is also an advantageous possibility, however, of connecting a buffer capacity to the output connections 18 of the separating device 15 and consequently to the load connection 14, which in the event of any short-term interruption in the aerating flow caused by the switchover of the separating device 15 maintains the required compressed-air supply of the connected load V. This buffer capacity is preferably normally supplied with compressed air from the load connection 14.

With the compressed-air system 1 of FIG. 2 there is the advantageous possibility, before testing the two working valves 2, 3 of examining the separating device 15 for its part for correct functional capability. It is preferably part of each examination cycle that prior to examining the two working valves 2, 3 the functional capability of the separating device 15 or of the multi-position valve 15*b* is examined. To this end, the multi-position valve 15*b*, starting from the neutral position illustrated in FIG. 2, is switched over to the first separated position and then back again to the neutral position, and then to the second separated position and back again to the neutral position. The functional test of the multi-position valve 15*b* takes place when both working valves 2, 3 assume the aerating position, so that the two-channel capability is guaranteed.

Only once it has been verified that the multi-position valve 15*b* is functioning correctly, does a selective testing of the two working valves 2, 3 takes place, wherein again the two-channel capability is guaranteed.

The functional testing of the separating device 15 takes place using the self-function examination means 42 described above.

With both compressed-air systems 1 it is advantageous if the working valves 2, 3 can be examined for the complete valve lift, in order to reach a reliable conclusion on the functional capability, without adversely affecting the aeration of the load V.

A reliable venting can also be adversely affected by the fluid flow through the aeration channel 24, 25 being hindered, for example due to a blocked silencer 12. In order to also be able to perform an examination in this regard, it is advantageous if each working valve 2, 3 is assigned a control air reservoir 43, 44 shown by a dot-dash line in FIG. 2, filled with compressed air, before the relevant working valve 2, 3 is switched over to the venting position and which in the venting position of the relevant working valve 2, 3 can be via this working valve 2, 3.

By way of example, each working valve 2, 3 is assigned its own control air reservoir 43, 44, which is in constant fluid communication with the working connection 7, in that in the exemplary embodiment it is connected to the first or the second communication channel 22, 23. Consequently the control air reservoir 43, 44 is always filled with compressed air and kept full, if the assigned working valve 2, 3 is in the aerating position. If for a test activity the separated working valve 2, 3 is switched to the venting position, the air volume contained in the assigned control air reservoir 43, is vented via the working valve 2, 3 in the venting position. This venting flow is detectable by detection means shown by a dot-dash line and can be evaluated by the electronic controller 26, to which the detection means 45 are for practical purposes electrically connected. The detection means 45 are in particular designed so that they can detect a time-dependent pressure change or a flow of the compressed air venting flow from the control air reservoir 43, 44. From a comparison with stored reference values it is then possible to determine if the venting time is too long in comparison with a correct venting time, allowing a blocked silencer or similar to be concluded. With the help of a flow sensor it can be directly verified if the flow rate of the venting flow is still sufficiently high or if it has dropped, which similarly indicates a blockage.

In an exemplary embodiment not shown the working connections 7 of the two working valves 2, 3 are connected to a common control air reservoir 43, 44, wherein through suitable valve technology it is ensured that the two working connections 7 do not interfere with each other.

In a departure from the exemplary embodiment there is the possibility of further developing the working valves 2, 3 so that on the output side, apart from the working connection 7 they also have a further in this regard separate filling connection, which alternately with the working connection 7 is connected with the compressed air source P or with the atmosphere. In this case the control air reservoir 43, 44 in the aerating position of the assigned working valve 2, 3 is vented and in the venting position of the working valve 2, 3 aerated, that is to say filled. This takes place for practical purposes with a control air reservoir assigned jointly to the two working valves. The correct penetrability of the silencer 12 is therefore always checked if the working valve 2, 3 switches to the aerating position and in doing so vents the assigned control air reservoir. Needless to say, in this case the detection means 45 are integrated into the channel system so that the compressed air venting flow can also actually be detected.

The invention claimed is:

1. A compressed-air system having a safety function, with a first and a second working valve, each of which has a working connection and a venting connection connected or connectable to the atmosphere, wherein the two working connections are connected in parallel fluid communication with one and the same load connection of the compressed-air system which load connection is connected or connectable to a load, wherein each working valve is switchable into a venting position, connecting its working connection with its venting connection and wherein the two working valves can simultaneously assume their venting position, and wherein each working valve also has a supply connection connected or connectable to a compressed-air source and selectively is switchable to an aerating position connecting its working connection with its supply connection or to its venting position, and wherein the venting cross-section enabled in the venting position by each working valve for flow of compressed air is bigger than the maximum aerating cross-section that can be enabled in the aerating position, and wherein, in the connection between the two working connections and the load connection, a separating device is inserted, allowing a temporary fluid-tight separation selectively of the working connection of the first working valve or of the working connection of the second working valve of both the load connection and the working connection of the respective other working valve and in doing so maintains a fluid communication between the load connection and the working connection not separated, and wherein switching function examination means are assigned to the two working valves which are able to check the switching function at least of the working valve, the working output of which is currently separated by the separating device from the load connection and from the working output of the other working valve, while this other working valve assumes its aerating position.

2. A compressed-air system according to claim 1, wherein the separating device is designed as fluid pressure-controlled 'OR' valve connected with both the two working connections and with the load connection, which is able to be switched over as a result of the pressure differential present at the two working connections.

3. A compressed-air system according to claim 1, wherein the separating device is designed as a multi-position valve which can be operated independently of the fluid pressures present on the working connections and which in a neutral position enables fluid communication between the two working connections and the load connection and which furthermore can be switched over alternately to one of two respective separated positions, in each of which it separates one of the two working connections in a fluid-tight manner from the load connection and from the respective other working connection and at the same time enables a fluid communication between the load connection and the respective other working connection.

4. A compressed-air system according to claim 1, wherein the switching function examination means contain position detection means responding to a positional change of a valve member of the working valve .

5. A compressed-air system according to claim 1, wherein the switching function examination means have pressure detection means, responding to a pressure change in the fluid pressure at the working connection upon switchover of the working valve.

6. A compressed-air system according to claim 1, wherein to each working valve is assigned a control air reservoir, which in the venting position can be vented via the related working valve, wherein detection means are present, through which a time-dependent pressure change or a flow of the associated compressed air venting flow can be detected and wherein either an own control air reservoir is assigned to each working valve or a common control air reservoir is assigned to both working valves.

7. A compressed-air system according to claim 6, wherein the control air reservoir is connected either to a working connection or to a filling connection of at least one of the working valves, wherein the filling connection is separate to the working connection and is connectable to the supply connection alternatively to the working connection.

8. A compressed-air system according to claim 1, wherein the separating device has self-function examination means assigned to it, through which the separating function of the separating device can be examined, while both working valves assume the aerating position.

9. A compressed-air system according to claim 8, wherein the self-function examination means of the separating device have position detection means responding to the positional change of a control valve member of the separating device.

10. A compressed-air system according to claim 1, further comprising an electronic controller, through which with uninterrupted aeration of the load connection a test procedure examining the function of the working valves can be brought about, in which starting from an operational state in which both working valves assume the aerating position, first one and then the other working valve is separated by the separating device from the load connection and from the respective other working valve, wherein the respective separated working valve is operated and by means of the switching function examination means undergoes a switching function examination, while the other working valve which still maintains the venting position, is connected to the load connection.

11. A compressed-air system according to claim 1, wherein the two working valves are electro-pneumatically operable.

12. A method for operating a compressed-air system having a safety function according to claim 1, wherein with uninterrupted aeration of the load connection, an examination process of the functioning of the working valves is carried out, in which based on an operating state, in which both working valves assume the aerating position, initially the first working valve and then the second working valve is separated by the separating device from the load connection and from the respective other working valve, wherein the respective separated working valve, while the other working valve remains connected with the load connection with maintenance of the aerating position, in the course of a test operation activity is switched over to the venting position and a correct switchover is verified with the help of the switching function examination means.

13. A method according to claim 12, wherein the working valve switched over to the venting position during the test operation activity is switched back to the aerating position, once verification of correct switchover to the venting position has taken place.

14. A method according to claim 12, wherein, in a compressed-air system, the separating device of which is designed as a fluid-pressure controlled 'OR' valve, the separation of the first or second working valve from the load connection is brought about in that the working valve to be separated is switched over to the venting position, wherein this switchover to the venting position is at the same time used as a test operation activity.

15. A method according to claim 12, wherein, in a compressed-air system, the separating device of which is designed as a multi-position valve, the separation of the first or second working valve from the load connection is brought about in that the multi-position valve starting from the neutral position is switched over to the one or to the other separated position, whereupon the test operation activity relating to the separated working valve is carried out with assigned switching function examination.

16. A method according to claim 15, wherein, before performing a test operation activity the multi-position valve is tested for correct functional capability, and wherein starting from the neutral position, it is switched over initially to the one and then to the other shut-off position and the correct switchover is verified with the help of the self-function examination means.

* * * * *